US006874548B1

(12) United States Patent
Durant

(10) Patent No.: US 6,874,548 B1
(45) Date of Patent: Apr. 5, 2005

(54) VACUUM PACKING MACHINE WITH INTERIOR SCALE

(76) Inventor: Will G. Durant, 248 Quincy Ave., Long Beach, CA (US) 90803

( * ) Notice: Subject to any disclaimer, the term of this patent is extended or adjusted under 35 U.S.C. 154(b) by 0 days.

(21) Appl. No.: 10/749,016

(22) Filed: Dec. 29, 2003

(51) Int. Cl.[7] ..... B65B 1/04
(52) U.S. Cl. ..... 141/83; 141/10; 141/313
(58) Field of Search ..... 141/10, 114, 83, 141/313–317; 53/403, 408, 510, 512

(56) References Cited

U.S. PATENT DOCUMENTS 3,542,091 A * 11/1970 Carter ..... 141/65
4,974,646 A * 12/1990 Martin et al. ..... 141/67
5,322,095 A * 6/1994 Bolz ..... 141/83
5,386,678 A * 2/1995 Kujubu ..... 53/434
5,573,044 A * 11/1996 Mechalas ..... 141/83

* cited by examiner

*Primary Examiner*—Steven O. Douglas
(74) *Attorney, Agent, or Firm*—Leonard Tachner

(57) ABSTRACT

A vacuum packer for filling valve bags employs a load cell-based scale mechanism located within the vacuum chamber. An interior packer front plate is supported from the back, inner wall of the chamber on four flexure spring check straps. The front plate is supported from a single load cell mounted on the back, interior wall of the vacuum chamber. Side bag retention plates, end retention plates and the lower bag support saddle are mounted to the packer front plate. A flexible connection is furnished between the back of the filling spout and the interior back wall of the vacuum chamber. All other required piping is made directly to the back wall of the chamber, thus removing them from the scale mechanism entirely.

7 Claims, 5 Drawing Sheets

VACUUM PACKING MACHINE WITH INTERIOR SCALE

BACKGROUND OF THE INVENTION

1. Field of the Invention

The present invention relates generally to packing machines which employ a vacuum to pack low density powder materials into valve bags and provide an accurate amount of such material based on the weight of the filled bag.

2. Background Art

The original vacuum packer designed especially for packing light density powders into valve bags was invented in the late 1950's by Clarence Carter. That machine comprises a basic framework. This framework supports a weighing scale mechanism. Suspended from the weighing mechanism is a large vacuum chamber with an access door on one side of the chamber. This chamber is suspended from the scale mechanism and checked back to the frame with check rods to keep the chamber from swinging laterally and longitudinally.

Mounted within the chamber and to the chamber is the bag filling spout, bag support chair, interior side panels, vacuum and atmosphere piping connections and a clean-out port. All of these devices are attached to the chamber and therefore suspended from the weigh scale mechanism.

To operate the machine, an operator would place an empty valve bag onto the filling spout of the machine. The chamber door would close and the chamber would be evacuated of air by a vacuum pump.

The product feed valve would then be opened, thereby admitting product into the valve bag by drawing air through the pores of the bag and pulling the product into the bag.

Upon reaching the desired set weight, the machine would stop the flow of product into the bag. Then, after a preset time, the chamber doors would open and the bag would be removed from the filling machine.

The original design had several problems that have proven very difficult to overcome. The problems were as follows:

The fact that the entire chamber, side plates, interior retention panels, and other mechanical devices are suspended from the scale mechanism requires a scale capable of supporting approximately 500 pounds of tare weight, while attempting to accurately weigh a bag to a weight of typically 10 to 20 pounds. Therefore the resolution of the scale mechanism has to be set to operate at 500 pounds.

The fact that the entire chamber with the related control devices is suspended from the scale mechanism requires several flexible connections between the main framework of the machine and the scale supported chamber. These connections include the connection from the product feed tube to the filling spout, the connection for the vacuum and atmospheric valve piping, and the connection for the lower chamber clean-out valves. Each of the connections requires extremely careful alignment between the chamber and the main framework.

In addition, the chamber itself has a tendency to distort when under vacuum. This distortion greatly affects the scale readout. This is especially true when using a single load-cell type of scale detection, as these devices are extremely sensitive to any distortion of the live load.

The combination of these factors produces a difference in the scale reading of up to three pounds of the scale supported chamber weight when under vacuum conditions and when under atmospheric conditions.

The difference in reading makes it extremely difficult to maintain consistent, accurate weights of the filled bags. In an effort to overcome these problems, the machine operators continuously manipulate the final cut-off point of the scale system to compensate for errors caused by the above outlined conditions.

As a result of the above problems, a new and novel approach is required to the arrangement of the chamber and scale or weighing system as applied to vacuum packers.

SUMMARY OF THE INVENTION

The vacuum packer of the present invention employs a load cell based scale mechanism located within the vacuum chamber.

With modern load cell technology, it is feasible to place the scale mechanism within a frame mounted vacuum chamber. This is accomplished in the following manner.

An interior packer front plate is supported from the back, inner wall of the chamber on four flexure spring check straps. The front plate is supported from a single load cell mounted on the back, interior wall of the vacuum chamber. Side and end bag retention plates and the lower bag support saddle are mounted to the packer front plate. A flexible connection is furnished between the back of the filling spout and the interior back wall of the vacuum chamber. All other required piping is made directly to the back wall of the chamber, thus removing them from the scale mechanism entirely.

In addition, the load cell supporting the scale is vented to atmosphere, thus eliminating any scale influence caused by a pressure differential between the inner workings of the load cell and the external load cell casing. This arrangement has been proven to reduce weight error between full vacuum and atmospheric pressure from two to three pounds to not more than 0.05 pounds. The machines can be fully automatic and do not require a machine operator to constantly adjust or manipulate the scale set points and cut-off points in an effort to get consistent package weights.

The arrangement also has several other advantages over the present technology. By removing the chamber itself from the weigh scale, a scale of much less total weight range may be utilized, thus improving the weight resolution of the scale. With the new arrangement, only one connection, that being the connection of the product supply tube to the filling spout, must be flexible. All other piping connections to the chamber may be rigid connections. Also, by removing the vacuum chamber itself from the weigh mechanism, there is no risk of weight error by an operator coming into physical contact with the external surface of the chamber during the filling process, thus causing weight inconsistency. Also, removing the vacuum chamber itself from the weigh mechanism enables the user to connect additional dust collecting and ventilation systems to the chamber doors without the risk of affecting the weight scale.

In addition, the new arrangement greatly simplifies the construction of the machine inasmuch as the vacuum casing can be directly bolted to the main framework of the machine without the need for external check rods, intermediate support frames and other chamber support devices previously used to isolate the chamber from the main framework of the machine.

The new arrangement thus makes it possible to fully automate the vacuum packer and maintain accurate weights.

DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
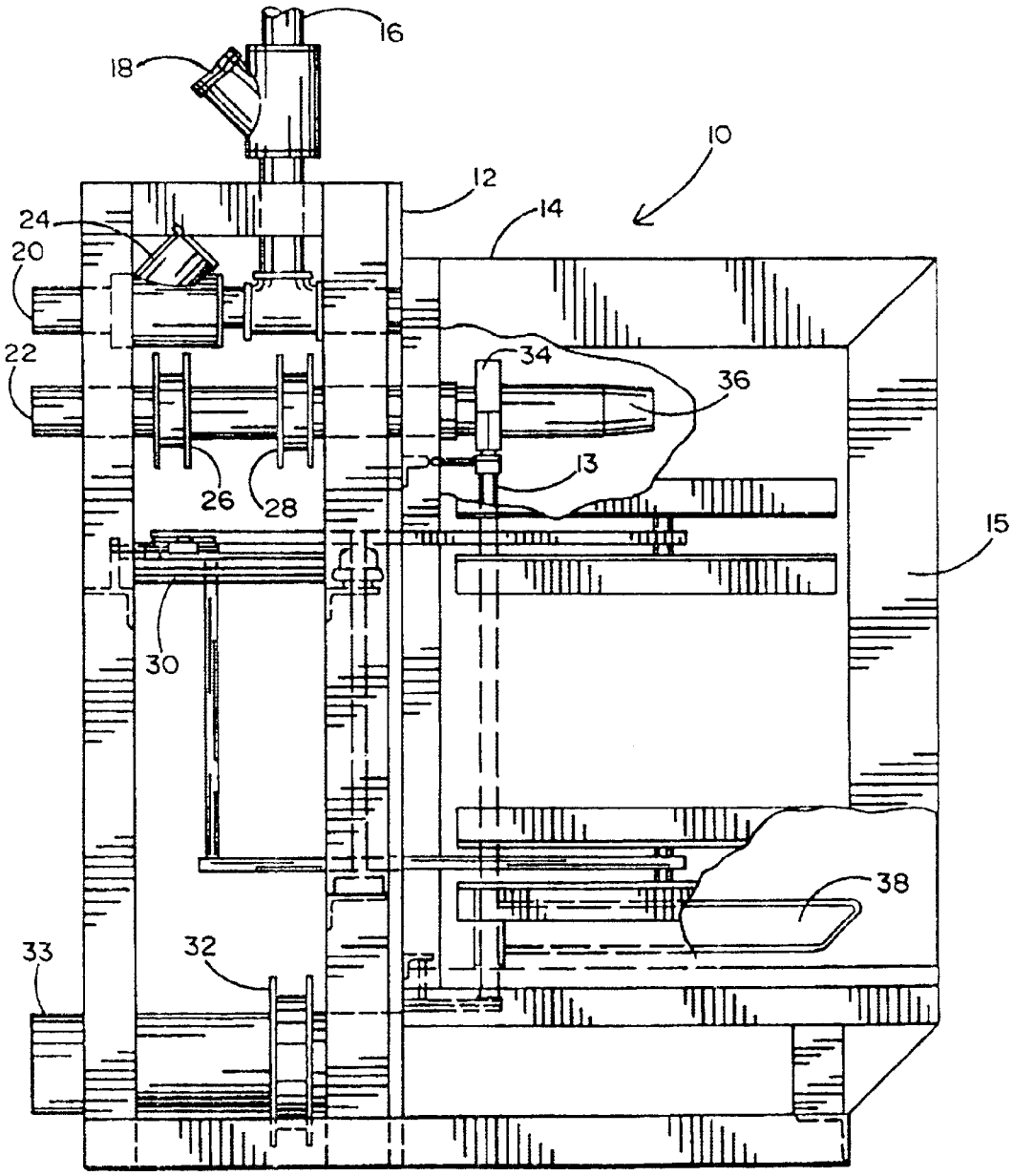
FIG. 1 is a side view of a preferred embodiment of a vacuum packer in accordance with the present invention.
Figure 2:
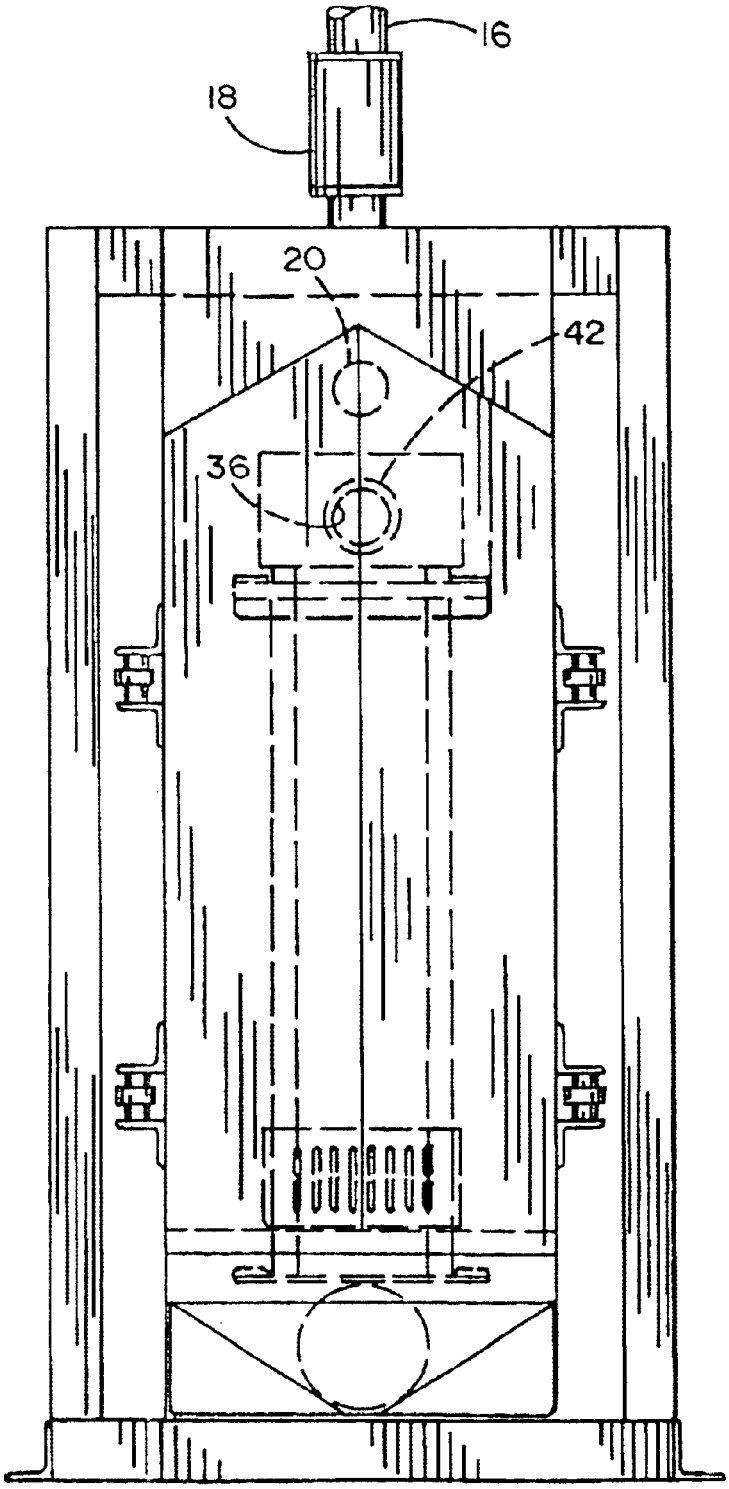
FIG. 2 is a front view of the preferred embodiment.

Referring to the accompanying drawings, it will be seen that a preferred embodiment 10 of a vacuum packer in accordance with the inventive features hereof is shown therein. More specifically, as seen for example in FIGS. 1 and 2, the packer 10 comprises a weighing section 13 and a chamber section 15 interconnected at a frame wall 12. The chamber section 15 comprises a vacuum line 16 and an atmosphere line valve 18 which are used to control air pressure reduction in the chamber section 15. Section 15 also provides a vent line 20 and a feed line 22. The vent line is used to selectively relieve the vacuum in the weighing chamber through a vent atmosphere valve 24. The feed line provides the particulate material to be packed into each bag. A pair of valves, namely, bulk butterfly valve 26 and trim butterfly valve 28, are employed to control flow in the feed line. Chamber 15 also provides a door opening and closing mechanism 30 and a dust collection vent line 33 controlled by a butterfly valve 32.

Figure 3:
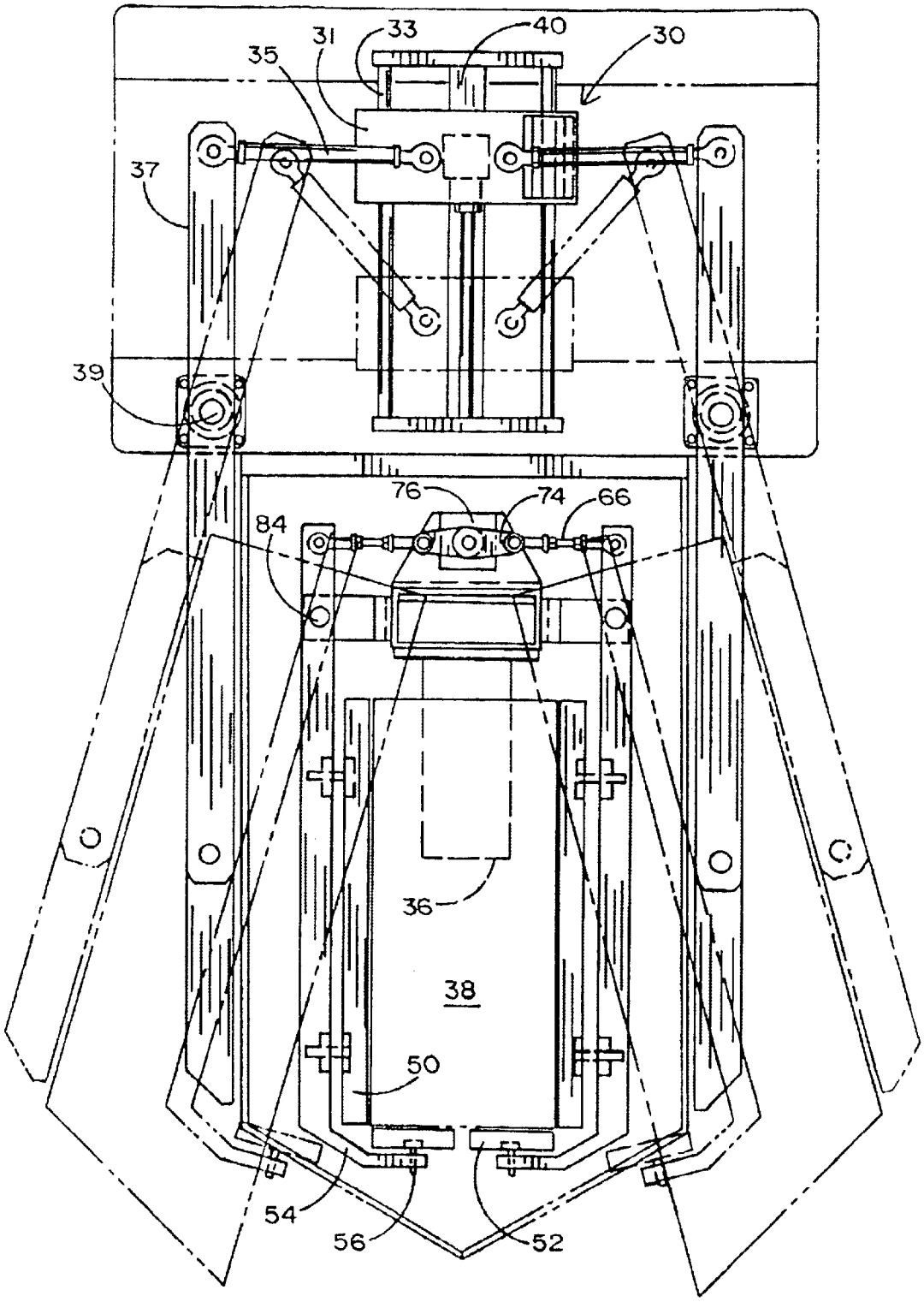
FIG. 3 is a top view of the preferred embodiment.

Door opening and closing mechanism 30 is better understood by referring to FIG. 3. As seen therein, a carriage 31 rides on a pair of rails 33 thereby rotating and translating a pair of the rods 35. The rods are connected at one end to the carriage 31 and at another end to the respective doors 37. Doors 37 are rotatably affixed to axial pivots 39 about which they rotate to open and close the packer. The position of carriage 31 and thus of doors 37, is controlled by an actuator 40.

Figure 4:
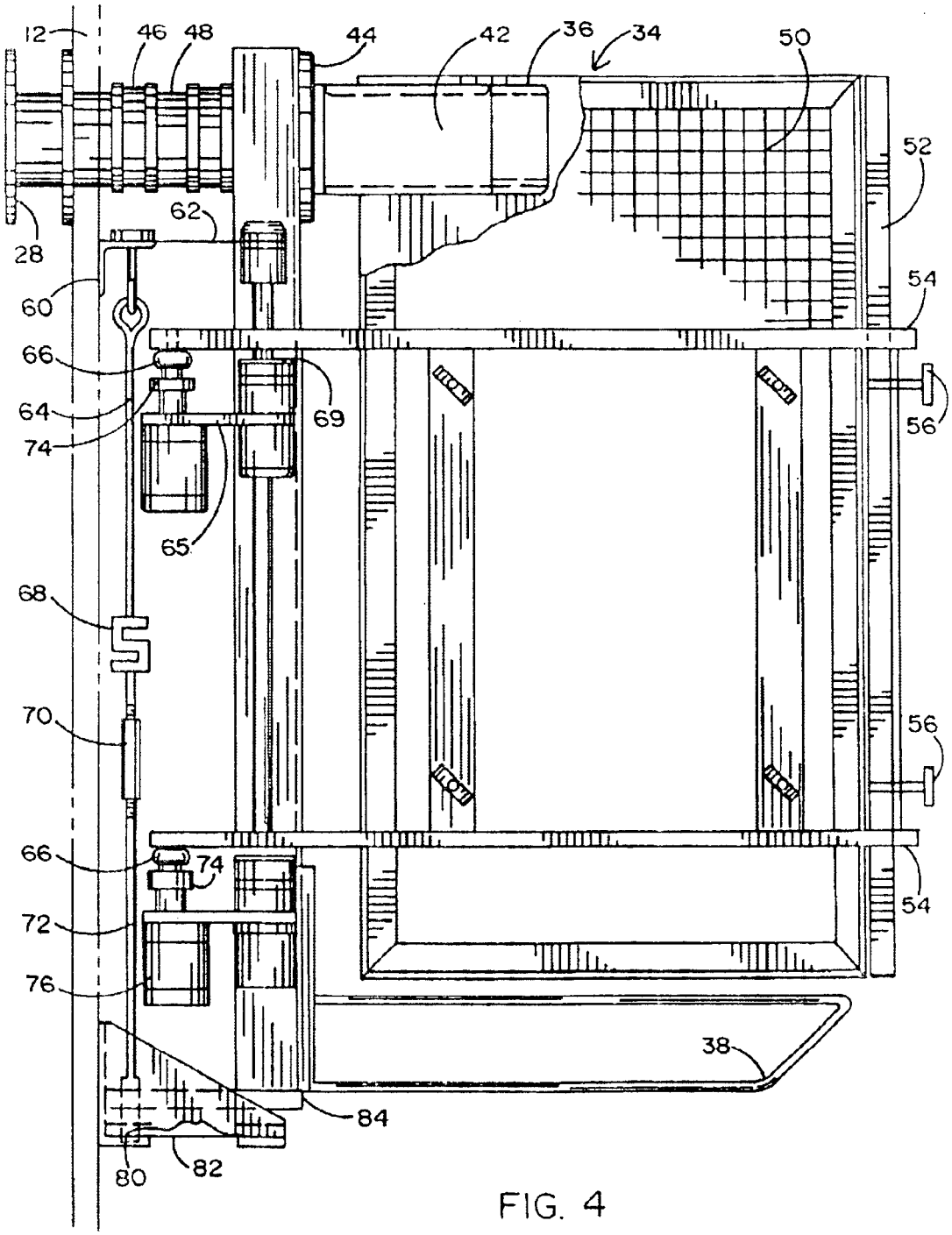
FIG. 4 is an enlarged side view of the internal scale subassembly of the preferred embodiment.
Figure 5:
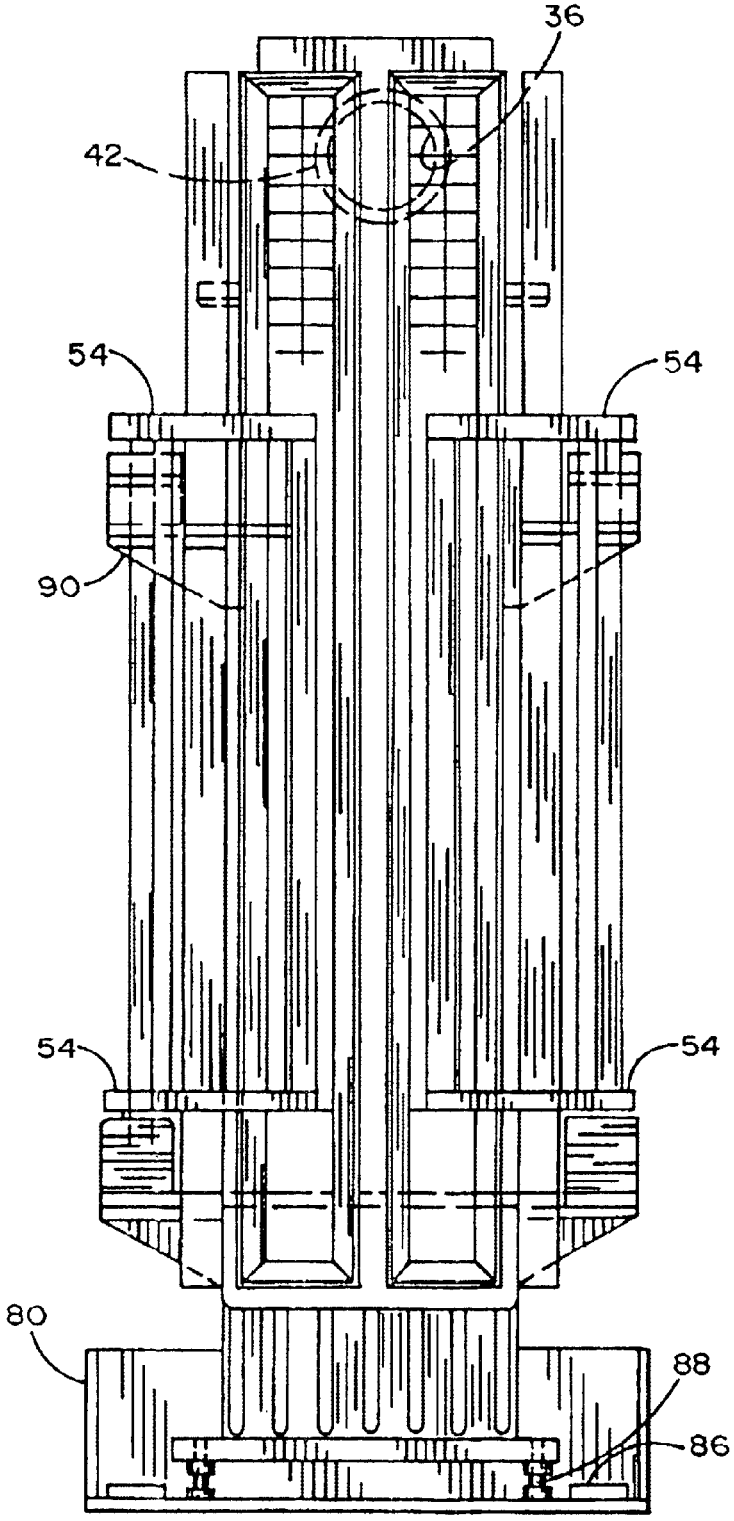
FIG. 5 is an enlarged front view of the internal scale subassembly.

The interior of weighing section 13 is best understood by referring to FIGS. 3, 4 and 5. Within section 13 is a scale and inner panel assembly 34 comprising a feed system spout tip 36 and a bag support assembly 38. Spout tip 36 is the terminus of a filling spout assembly 44 which includes an inflatable boot 42. The bag filling spout assembly 44 is connected through intermediate connector 48 and dust seal 46 to the feed line 22 and associated butterfly valves 26, 28.

The bag being filled is trapped within a plurality of retainer screens including side retainer screens 50 and end retainer screen 52, all of which are controlled for opening and closing by pivot arms 54 and associated knobs 56. Pivot arms 54 are opened and closed by rotary actuators 76 connected through crank arms 74 and spherical rod ends 66.

Weighing of the bag being filled is accomplished by means of a load cell 68. Load cell 68 is positioned between upper lift rod 64 and lower lift rod 72 and may be adjusted for height using turnbuckle adjuster 70. This assembly is supported on frame angle mounts 60 and 80. The bag support and spout assembly is connected by upper flexures 62 and lower flexures 82. Also included in the weighing function is a hinge rod 84 connected through flange mount bearings 69. Also shown in FIG. 4 are cross plates 65 and in FIG. 5 is a flexure clamp block 86, adjustment studs 88 and cross plate brackets 90, each of which serve structural support functions.

It will now be understood that the present invention comprises a novel configuration of a bag weighting device inside a vacuum packing apparatus so that a more accurate and higher resolution weight of bag and material therein may be achieved. While a preferred embodiment of an illustrative apparatus employing this unique feature has been described herein, various modifications and additions may be made to the invention while retaining this unique feature. Accordingly, the scope hereof is to be limited only by the appended claims and their equivalents.

I claim:

1. An apparatus for vacuum packing a valve bag with particulate material while simultaneously weighing the filling bag to achieve a selected total weight when the packing is terminated; the apparatus comprising:

a frame having a chamber section and a weighing section, said sections being separated by frame wall;

said chamber section having connections to a feed line, a vacuum line and a vent line and having a door control mechanism;

said weighing section having a bag support device selectively enclosed by a plurality of screen doors and being in cantilevered relation to a weighing device within said weighing section; and said frame having outer doors controlled by said door control mechanism for opening and closing said weighing section for selectively providing a vacuum in said weighing section for filling a bag with said material.

2. The apparatus recited in claim 1 wherein said weighing device comprises a load cell.

3. The apparatus recited in claim 1 wherein said weighing section comprises a spout for receiving a bag to be filled, said spout being connected to said feed line by a flexible connection.

4. An apparatus for filling a bag under at least a partial vacuum and weighing the bag during filling to provide a filled bag having a selected weight; the apparatus comprising:

a frame having an evacuatable interior for receiving a bag on a spout connected to a source of material for filling said bag; and a weighing device within said interior for measuring the weight of said bag as said bag is being filled;

wherein said bag is secured within said interior by a plurality of screens.

5. The apparatus recited in claim 4 wherein said weighing device comprises a load cell.

6. The apparatus recited in claim 4 wherein said spout is decoupled from said frame to avoid inaccuracy in weighing said bag.

7. The apparatus recited in claim 4 wherein said bag is positioned in cantilevered relation with said weighing device while said bag is being filled.

* * * * *